US005953783A

United States Patent [19]

Hahn

[11] Patent Number: 5,953,783

[45] Date of Patent: Sep. 21, 1999

[54] MATERIAL AND IMPLEMENT FOR CLEANING THE SURFACES OF TEETH AND DENTURE MATERIALS

[76] Inventor: Rainer Hahn, Schwabstr. 11, D-72074 Tübingen, Germany

[21] Appl. No.: 08/849,028

[22] PCT Filed: Nov. 28, 1995

[86] PCT No.: PCT/EP95/04676

§ 371 Date: Jun. 25, 1997

§ 102(e) Date: Jun. 25, 1997

[87] PCT Pub. No.: WO96/16573

PCT Pub. Date: Jun. 6, 1996

[30] Foreign Application Priority Data

Nov. 28, 1994 [DE] Germany ..... 44 42 001

[51] Int. Cl.[6] ..... A46B 9/02

[52] U.S. Cl. ..... 15/167.1; 15/207.2; 15/227

[58] Field of Search ..... 15/167.1, 207.2, 15/227; 428/90, 92

[56] References Cited

U.S. PATENT DOCUMENTS

| | | | |
|---|---|---|---|
| 1,179,426 | 4/1916 | Hamilton | 15/207.2 |
| 2,599,191 | 6/1952 | Meunier | 15/167.1 |
| 3,103,679 | 9/1963 | Clemens | 15/167.1 |
| 3,325,845 | 6/1967 | Sawkiw . | |
| 3,335,443 | 8/1967 | Parisi et al. | 15/167.1 |
| 3,337,893 | 8/1967 | Fine et al. | 15/167.1 |
| 3,354,491 | 11/1967 | Schlegel et al. | 15/167.1 |
| 4,030,845 | 6/1977 | Deckert . | |
| 4,576,190 | 3/1986 | Youssef | 15/167.1 |
| 4,616,374 | 10/1986 | Novogrodsky . | |
| 4,679,274 | 7/1987 | Friedman | 15/167.1 |
| 5,678,273 | 10/1997 | Porcelli | 15/167.1 |

FOREIGN PATENT DOCUMENTS

| | | | |
|---|---|---|---|
| 94 08 268 | 7/1994 | Germany . | |
| 2-283312 | 11/1990 | Japan | 15/167.1 |

OTHER PUBLICATIONS

Koch P.–A. et al.: Grosses Textil–Lexikon, vol. 2, Stuttgart 1966, pp. 171, 172.

*Primary Examiner*—Terrence R. Till

[57] ABSTRACT

A tooth cleaning apparatus has a working surface formed by fibrous cleaning elements of different lengths and of very small diameters at their working ends. The cleaning elements are fixed on a base fabric, which is reinforced by a foam layer and thus forms a deformable hollow unit that is then attached to a handle. The pile-like cleaning elements facilitate very effective cleaning even of the fine surface contours of curved tooth surfaces.

52 Claims, 14 Drawing Sheets

10

18
16
20
23
32
22
30
14
12
28
24

28

24
32
30
26

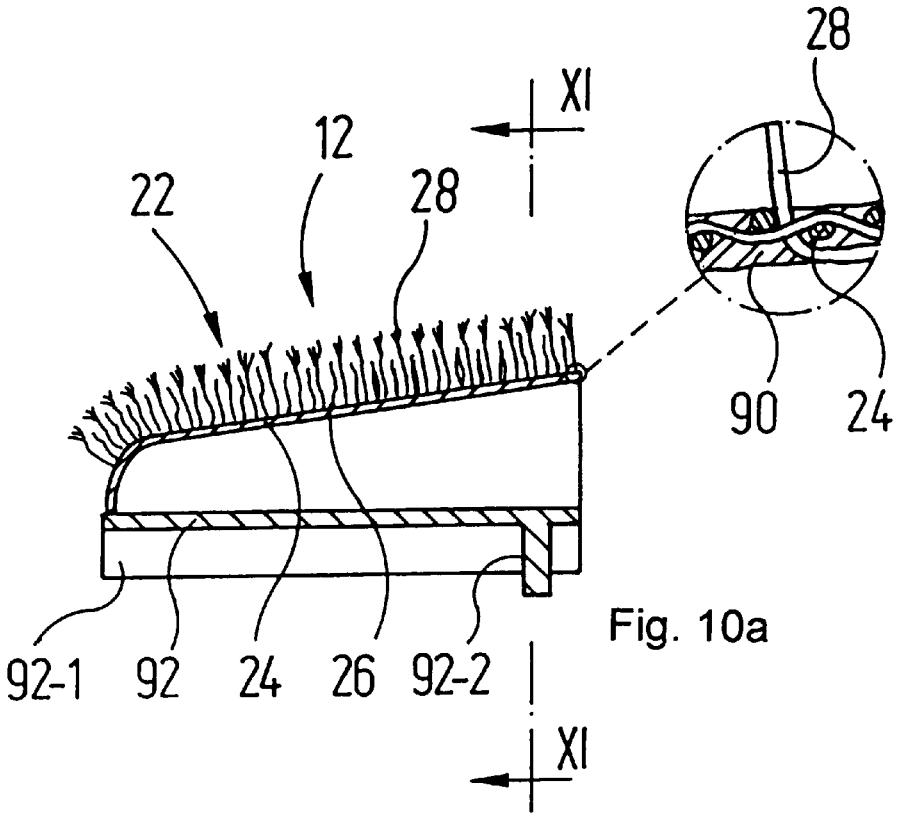
Fig. 10b
Fig. 10a
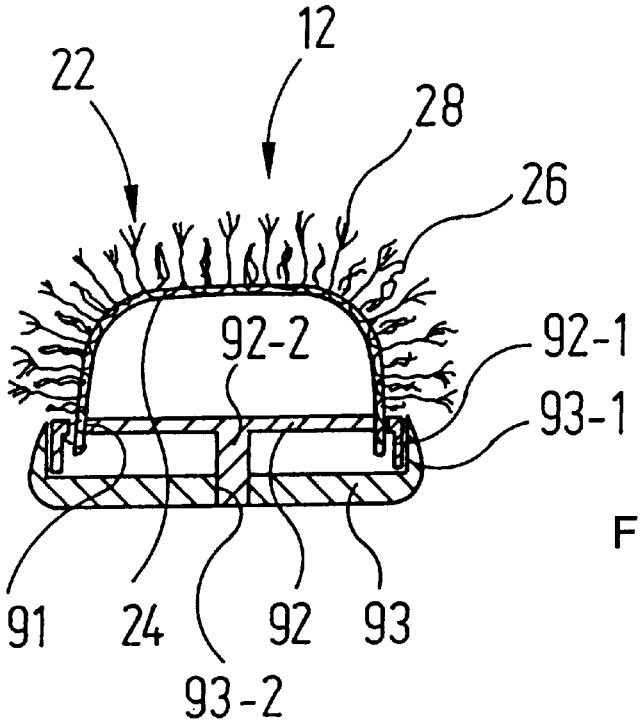
Fig. 11

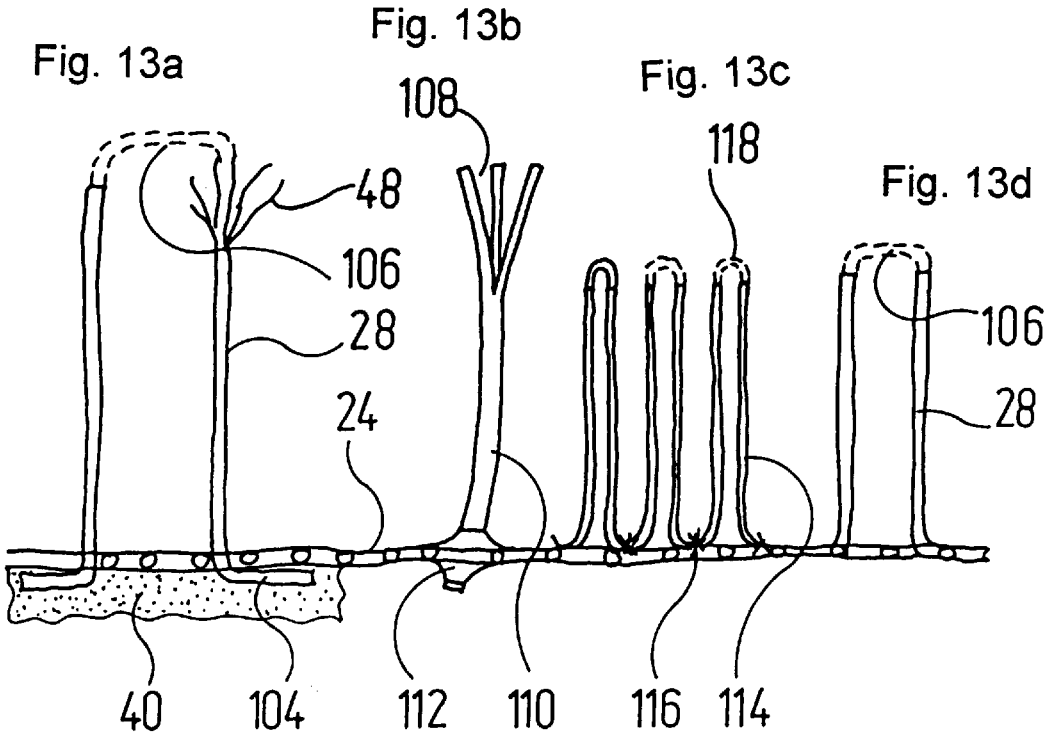
Fig. 13a
Fig. 13b
Fig. 13c
Fig. 13d
108
118
48
106
28
24
106
28
40
104
112
110
116
114
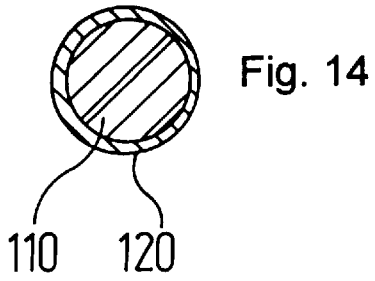
Fig. 14
110
120
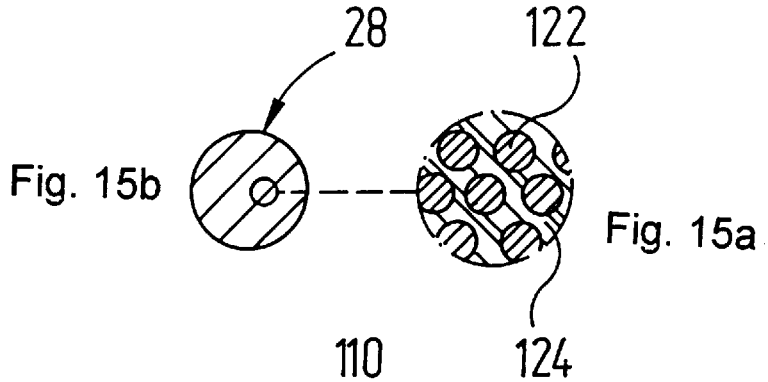
28
122
Fig. 15b
Fig. 15a
124
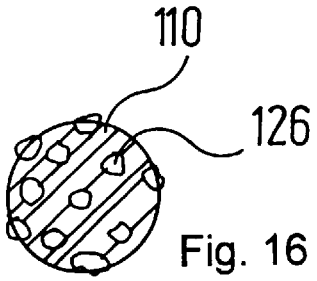
110
126
Fig. 16

MATERIAL AND IMPLEMENT FOR CLEANING THE SURFACES OF TEETH AND DENTURE MATERIALS

CROSS-REFERENCES TO RELATED APPLICATION

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to a material for cleaning the surfaces of teeth and denture materials having a base member and a plurality of cleaning elements carried by the base member, which cleaning elements have small transverse dimensions compared with their length and to an implement for cleaning the surfaces of teeth and denture materials that has a piece of cleaning material produced from such a material.

2. Discussion of Relevant Art

Known teeth cleaning implements in the form of toothbrushes, as are disclosed, for example, in DE-A-26 52 744, have some 100 to about 1500 bristles inside a bristle area which are fastened to the underside of a normally rectangular flat bristle carrier.

In the case of such known teeth cleaning implements, owing to the diameter of the bristles (0.1 to 0.3 mm) the ends of the individual bristles are not able to penetrate into the fine surface relief of the teeth or denture surfaces to be cleaned. A toothpaste is therefore advised, the finely disperse particle additives of which are moved by the ends of the bristles and enable the surface relief to be cleaned.

Teeth cleaning implements that have resilient foam bodies have also already been proposed (DE-A-36 21 815). Although these roughly conform to the surface of the teeth, once again toothpastes are advised for cleaning the fine surface relief.

SUMMARY OF THE INVENTION

By means of the present invention, a material for cleaning teeth having a base member and a plurality of cleaning elements carried by the base member, which cleaning elements have small transverse dimensions compared with their length is to be so developed that reliable, residue-free cleaning of the surface relief of teeth and denture surfaces is achieved therewith in a simple manner and in a short time.

That problem is solved according to the invention by a teeth cleaning material having a base member that is flexible, bendable structure and cleaning elements are carried by the base member in the manner of pile loops or pile threads.

BRIEF DESCRIPTION OF THE DRAWINGS

The subclaims relate to advantageous developments of the invention.

The invention is described in greater detail below with the aid of preferred embodiments and with reference to the drawings in which:

FIGS. 10A and 10B: shows a longitudinal section through a shoe-like cleaning head;

FIG. 11: shows a transverse section through the cleaning head of FIGS. 10A and 10B, along the line of section XI—XI therein;

FIG. 13: is an enlarged schematic view showing various alternatives for attaching cleaning elements to a base member of a teeth cleaning implement according to one of FIGS. 1 to 12;

FIG. 14: shows a transverse, again enlarged, section through a monofilament cleaning element of FIG. 13;

FIGS. 15A and 15B: shows a transverse section through a modified multifilament cleaning element for a teeth cleaning implement according to one of FIGS. 1 to 12;

FIG. 15B: is a sectional view similar to FIG. 16, showing a further modified monofilament cleaning element in section;

Figures 1A, 1B, 1C:
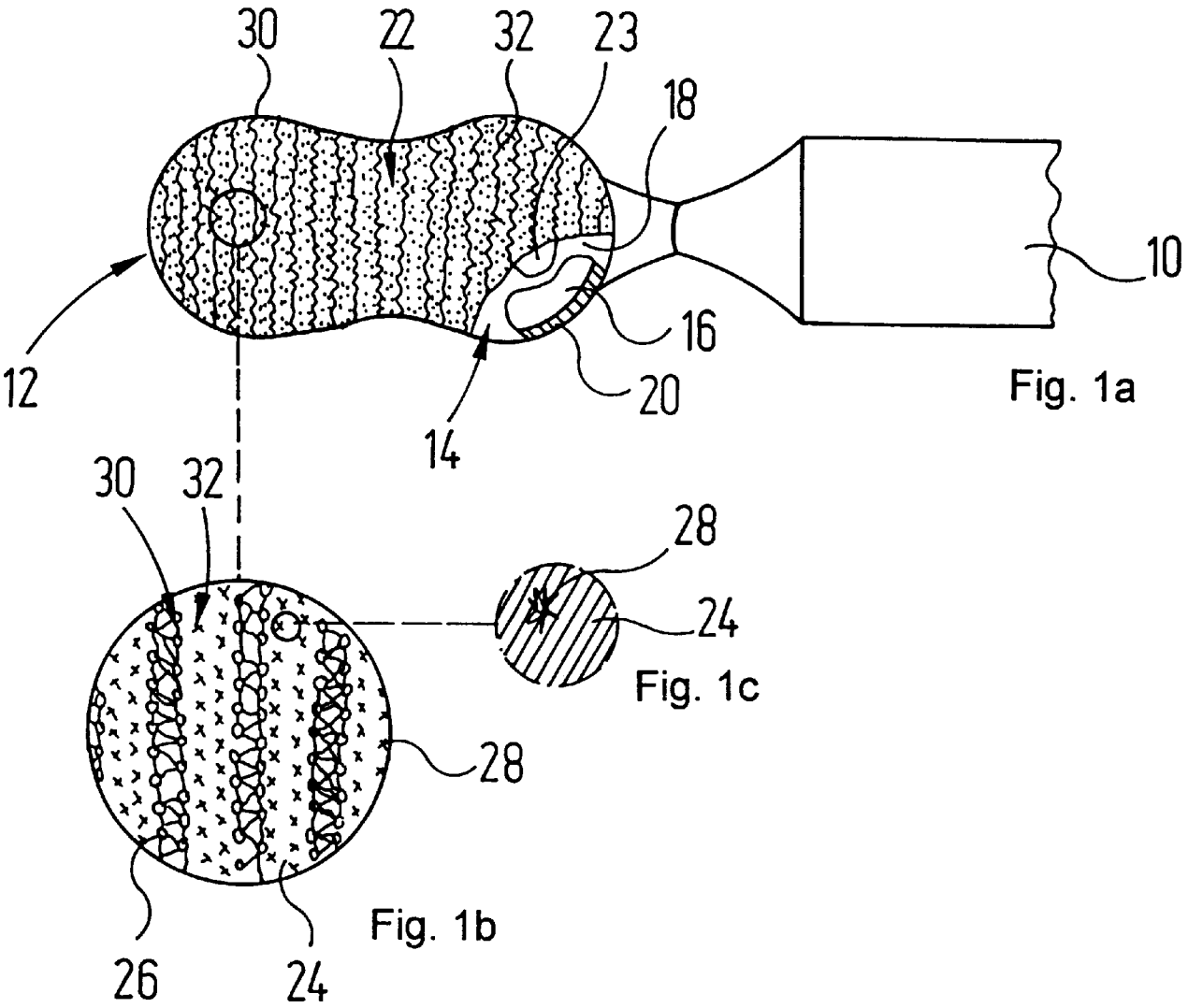
FIGS. 1A–1C: is a plan view of the working face of a teeth cleaning implement.

The teeth cleaning implement shown in FIGS. 1A to 1C has a handle 10 on which a cleaning head designated 12 overall is detachably mounted, for example pushed or clipped on.

The cleaning head 12 has a head body 14 in the form of flat hollow body with a rear wall 16 and a front wall 18 and a curved side wall 20 connecting those two walls.

Accordingly, viewed in transverse section, the head body 14 is substantially rectangular but with the narrow sides of the rectangle being semi-circular.

A cleaning cover 22 is fitted to the front wall 18, for example is glued thereto (adhesive layer 23) or welded thereto or attached by means of a hook-and-loop fastening.

The cleaning cover 22 has a flexible base member 24 which may be a woven fabric, a knitted fabric, a braid, a nonwoven fabric, a felt, a sheaf of threads, a film or a composite material consisting of several of the aforementioned materials.

Filamentous cleaning elements 26 of a first length and filamentous cleaning elements 28 of a second, greater length are attached in the manner of pile threads to the base member 24. The cleaning elements can be attached to the base member by threading in, weaving in, gluing on or welding on of fibre loops, on the one hand, or also by drawing fibre portions of the base member out of the same in loops, the ends of the fibre loops then being cut open. Alternatively, the individual cleaning elements can be glued or welded to the base member. Preferably, the cleaning elements are fixed to the base member by impregnating the base member provided with cleaning elements with a synthetic resin which, after curing, firmly joins the cleaning elements to the base member and at the same time imparts a certain resilient flexural strength to the base member. Details will be described more precisely later.

For better clarity, in FIGS. 1A to 1C only relatively few cleaning elements are shown, but it will be appreciated that those cleaning elements are provided in greater density in practice, so that adjacent cleaning elements support one another and form a pile.

A practical embodiment of the material has the following properties:

Per $cm^2$ 400 multifilament cleaning elements each comprising 30 individual filaments are provided. Both the short cleaning elements 26 and the long cleaning elements 28 are unravelled at their ends, and the short cleaning elements 26 are, in addition, crimped and form a structure resembling felt. There are, therefore, about 12,000 active ends of individual filaments per $cm^2$. That number can be further increased by increasing the number of individual filaments in the individual cleaning element or by even closer packing of the same.

The material is a knitted velour with two different polyester threads which form both the base member and the two sorts of cleaning elements. The diameter of the multifilament fibres is approximately 0.5 mm.

The base knit (base member) has a weight per unit area of 120 $g/cm^2$ and is provided with a synthetic resin backing of 75 $g/cm^2$. The pile fibre material has an overall weight per unit area of 536 $g/cm^2$ half of which is formed by fibres of 2.3 dtex while the other half is formed by fibres of 13.9 dtex.

Modified knitted velour materials of that kind have a density of from 100 to 800 cleaning elements per $cm^2$.

If thin monofilament cleaning elements are used, the chosen density thereof will be higher, it being possible for the ends of the monofilament cleaning elements to be chemically split in addition, as will be described in more detail below.

The optimum density of cleaning elements in any individual case depends upon the material of which the cleaning elements consist, their cross-section, their structure (multifilament or monofilament), their conditioning (texturing, coating etc.), their projecting height above the base member, the properties of adjacent cleaning elements (for example, different length, different stiffness) and also on the grouping or surface distribution of the cleaning elements.

Details regarding the geometry of the individual cleaning elements and the material of which the cleaning elements consist are likewise described in more detail below.

As will be seen from FIGS. 1A to 1C, the cleaning elements 26 are arranged in transverse, strip-shaped regions 30 of the cleaning cover 22, while the long cleaning elements 28 are provided in transverse strip-shaped regions 32 between the regions 30.

As will be seen from FIGS. 1A to 1C, in plan view the cleaning head 12 has roughly the shape of a groundnut, the long axis of the cleaning head being of such a size that the working face of the cleaning head is able to cover two to three adjacent teeth (about 15 to 30 mm), while the height of the cleaning head 12 corresponds to the height of the crown of a tooth (about 5 to 15 mm, preferably about 10 mm).

Figures 2A, 2B:
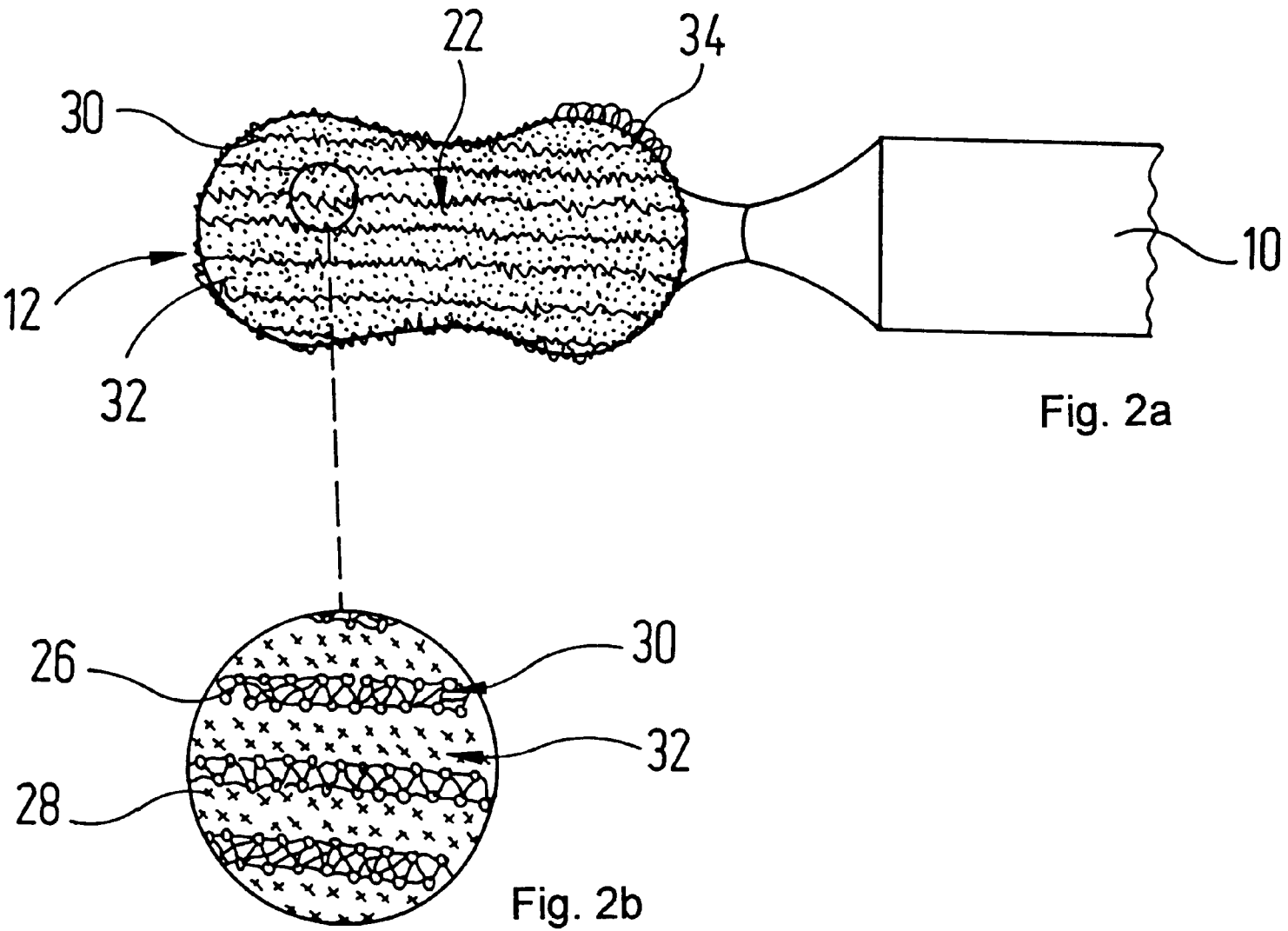
FIGS. 2A and 2B: is a plan view of the working face of a modified teeth cleaning implement.

The illustrative embodiment shown in FIGS. 2A and 2B largely corresponds to that shown in FIGS. 1A to 1C. Components having corresponding functions are again provided with the same reference numerals and will not be described in detail again.

In the case of the cleaning implement shown in FIGS. 2A and 2B, the strip-shaped regions 30 and 32 extend in the longitudinal direction of the cleaning head. Further provided at the edge of the cleaning cover 22 is a garland-shaped or helical further cleaning element 34 (or a plurality of such cleaning elements).

Figure 3:
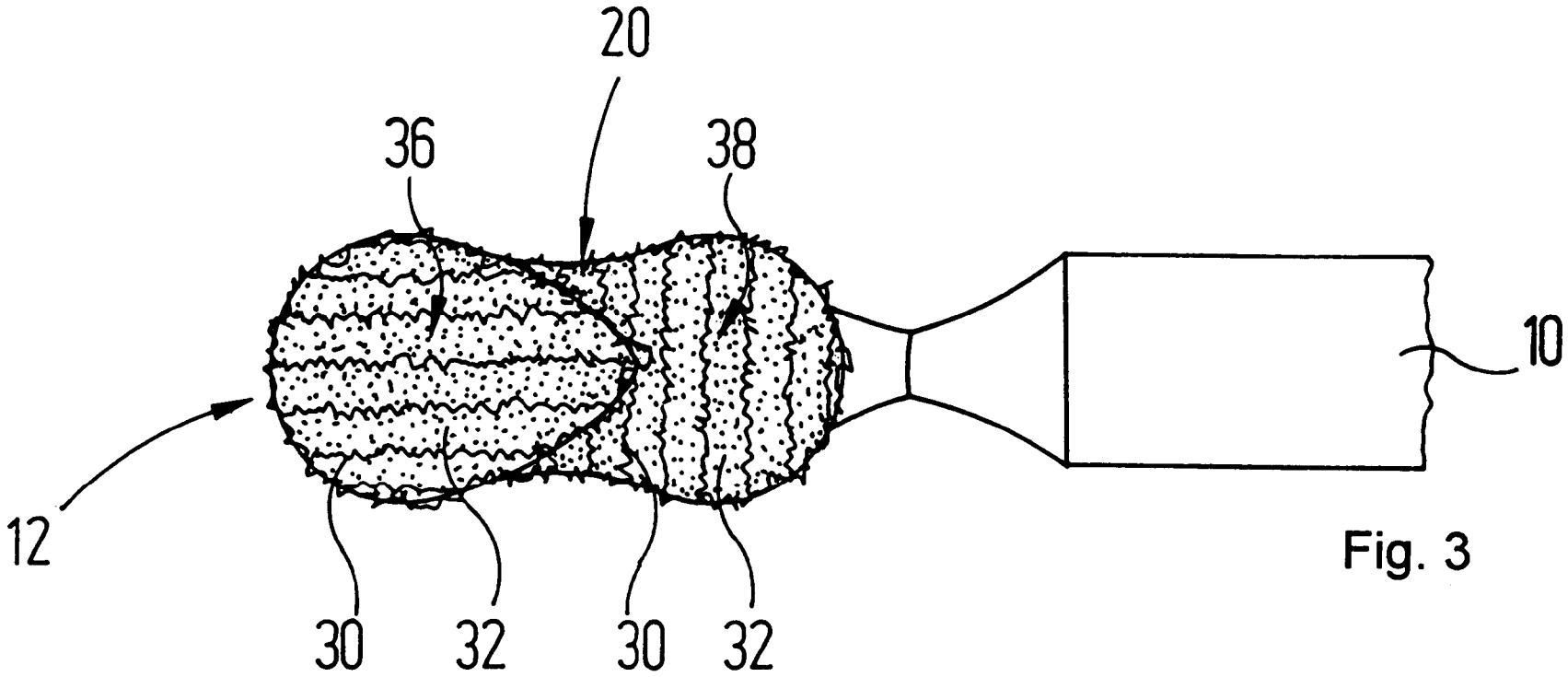
FIG. 3: is a plan view of the working face once more of a modified teeth cleaning implement.

In the case of the teeth cleaning implement shown in FIG. 3, the cleaning cover 22 is composed of a plurality of parts: in a droplet-shaped part 36 of the cleaning cover 22 on the left in the drawing, the strip-shaped regions 30 and 32 are arranged in the longitudinal direction, while in the part 38 of the cleaning element 22 forming the remainder of the working face, which is on the right in the drawing, the strip-shaped regions 30 and 32 are oriented transversely. The sub-areas 36, 38 of the base member 24 are fitted with strips of cleaning elements 26, 28, which strips are of different heights and are oriented in different directions, preferably perpendicular to each other.

Figure 4B:
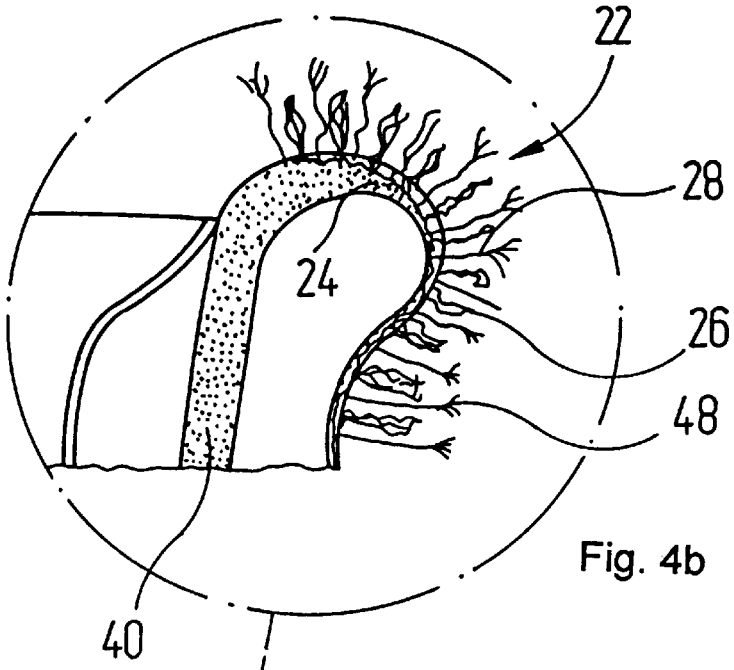
FIGS. 4A and 4B: shows a transverse section through a teeth cleaning implement according to one of FIGS. 1 to 3, in use on the lateral face of a tooth.
Figure 4A:
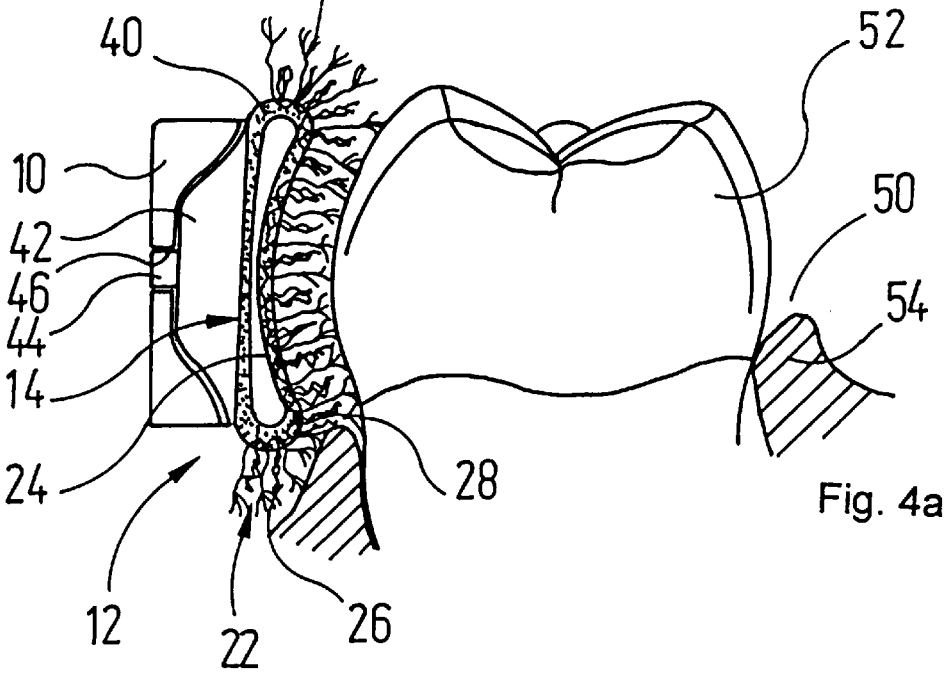

The cleaning implement shown in transverse section in FIGS. 4A and 4B has, when viewed from the side, a similar appearance to the cleaning implement shown in FIGS. 1A to 1C. It has a slightly different structure, however:

The cleaning elements 26 and 28 are attached to a tubular woven base member 24. The part of the tubular base member 24 remote from the cleaning face is not fitted with cleaning elements.

Attached to the inside of the tubular base member 24 is a foam layer 40 the thickness of which is small at the working face of the cleaning head 12 and large in the rearward region which is free of cleaning elements. At the same time as the foam layer 40 is being formed on, it and therefore also the base member 24 which is joined to it are given a transverse cross-sectional geometry that corresponds to a rectangle with arcuate narrow sides when the cleaning head is not under load.

The cross-sectional shape with the concave curvature of the working side which can be seen from the drawing is obtained when the cleaning head 12 is applied with force to the surface of a tooth, in which case the front wall of base member 24 and foam layer 40 curve in conformity with the curvature of the tooth surface. Since the foam layer 40 is only thin on the working side of the cleaning head 12, when pressure is applied to the cleaning head 12 the base member 24 is able to adapt, with resilient deformation of the actual surface, to the particular tooth being cleaned.

A connection part 42 is also integrally injection-moulded onto the rear side of the base member 24, which is reinforced by the foam layer 40, which connection part 42 is provided with a locking rib 44 which can be clipped into a locking groove 46 provided in the end of the handle 10.

Instead of using the foam layer 40, a layer of a different resilient plastics material can be used, it being possible in particular also to impregnate the base member with a synthetic resin that is resilient after curing.

As FIGS. 4A and 4B shows, the short cleaning elements 26 are formed by crimped pieces of thread. The longer cleaning elements 28 are twisted multifilament pieces of thread. In the long cleaning elements 28, however, the free end portions are unravelled so that the individual filaments 48 of the cleaning elements 28 forming a tuft are able to cooperate with the tooth surface. Where there are tooth pockets 50 between the outside of the tooth 52 under consideration and the adjoining gum 54, those filaments are able to enter the uppermost portion of the tooth pocket and remove any contamination present there, especially bacteria, food residues and plaque.

Figure 5:
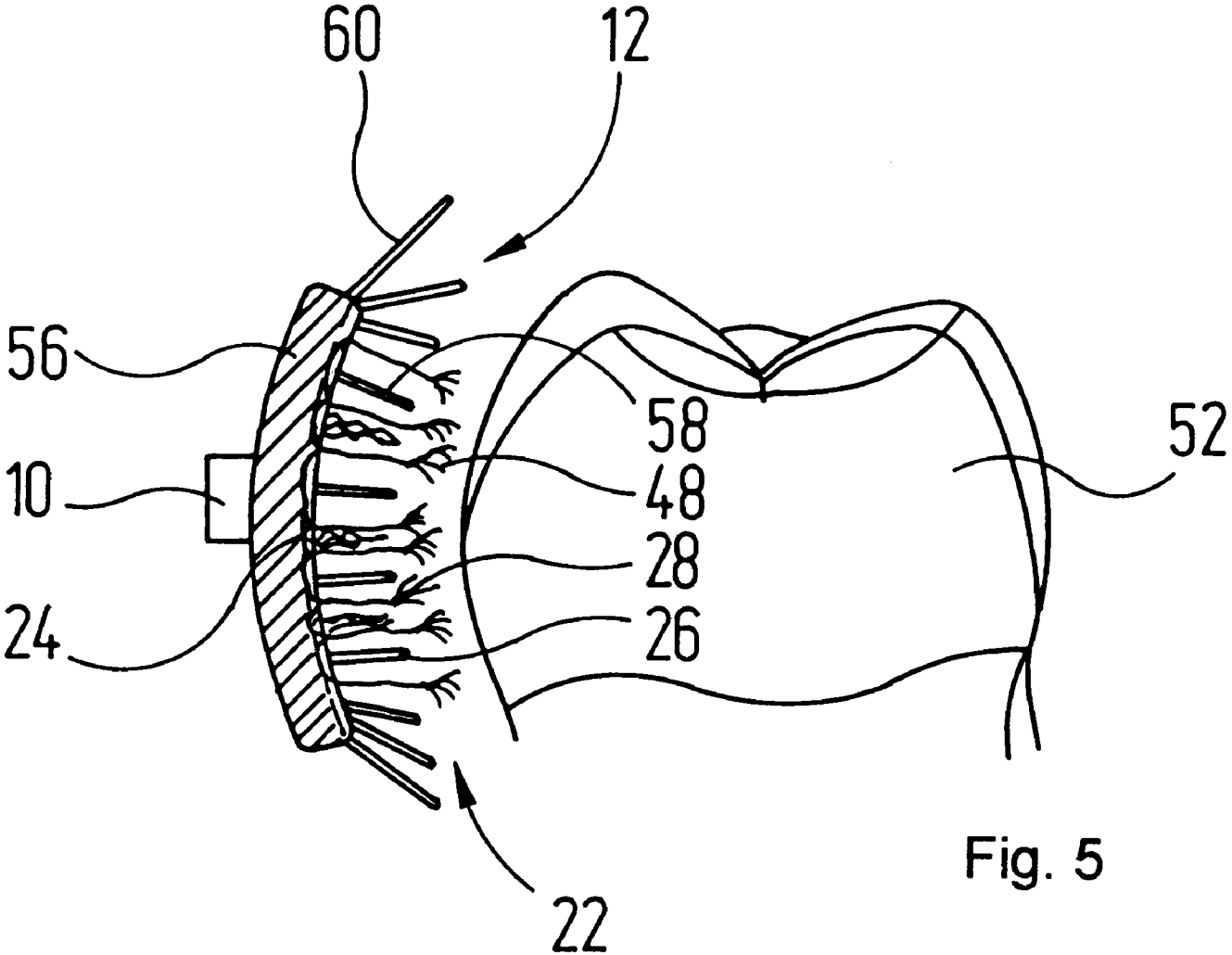
FIG. 5: is a view similar to FIGS. 4A and 4B, showing a further modified teeth cleaning implement.

In the case of the teeth cleaning implement according to FIG. 5, in the transverse cross-section of the cleaning head 12 there is a basic curvature adapted to the average curvature of the lateral face of a tooth.

The base member 24 carrying the cleaning elements 26 and 28 is in this case embedded in a head base 56 which is made from a resilient material and has a substantially arcuate transverse cross-sectional geometry.

Additionally provided between the cleaning elements 26, 28 are bristles 58 which are fastened in the base member 24 and in the head base 56.

In the portions adjoining the edges of the cleaning head 12, the base member 24 and the head base 56 are additionally joined to other, longer bristles 60 which radiate in different directions as can be seen from FIG. 5. In that manner, the curvature of the working face of the cleaning head 12 is again adapted to the average curvature of the lateral face of a tooth, and the lengthened bristles 60 which are inclined to the working side of the head base 6 are able to penetrate into the upper portions of the tooth pockets.

The head base 56 again carries a connection part 42 for attachment to a handle.

Figure 6A:
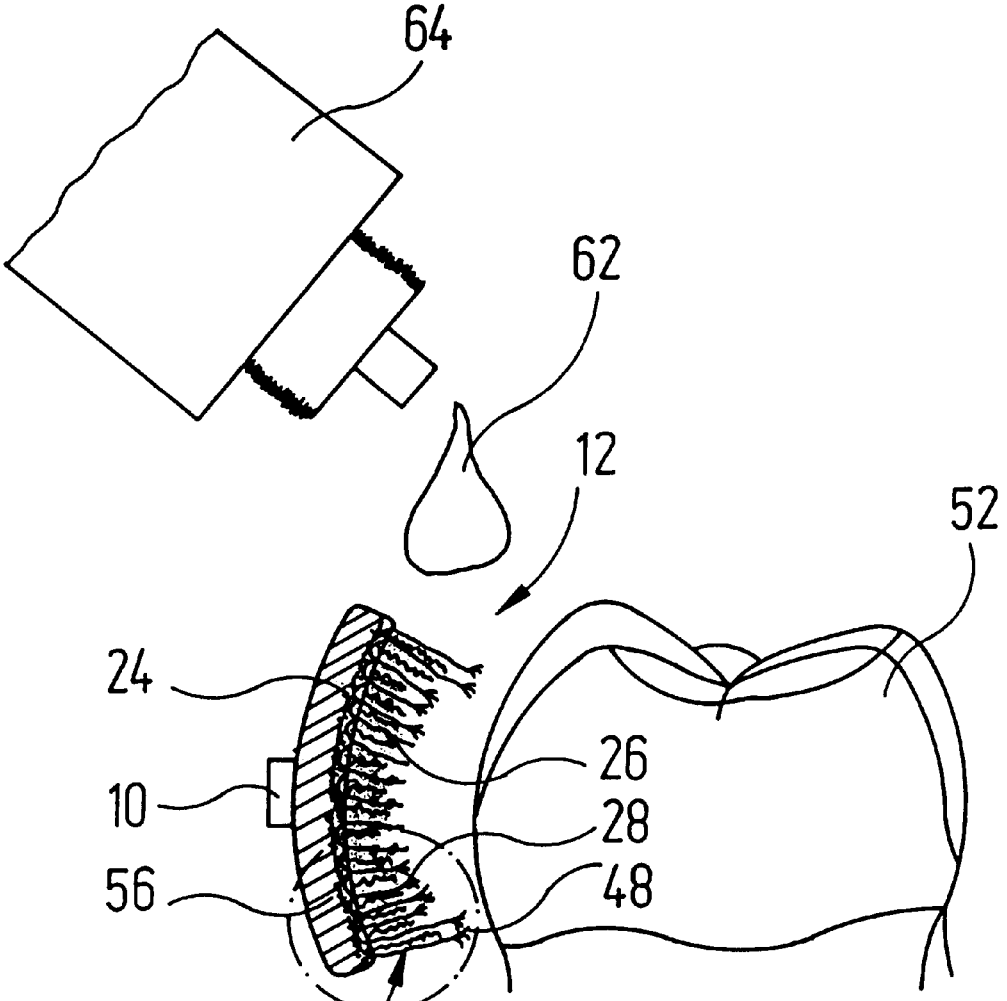
FIGS. 6A and 6B: is a view similar to FIG. 5, showing once more a modified teeth cleaning implement.
Figure 6B:
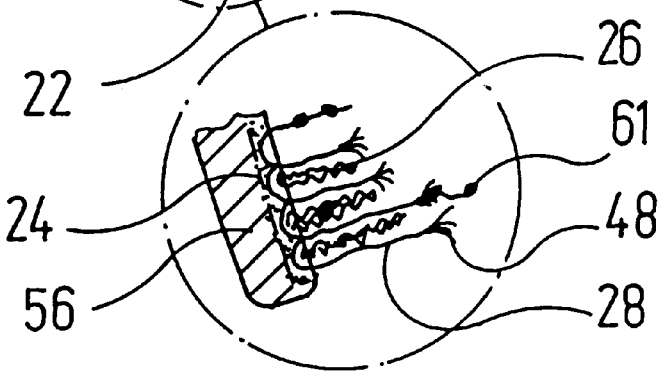

The illustrative embodiment shown in FIGS. 6A and 6B largely corresponds to that shown in FIG. 5, except that the cleaning elements 28 have an increasingly greater length towards the edge of the cleaning head 12 and extend towards the mid-point of the curvature of the head base 56. The same applies to the cleaning elements 26. The cleaning elements 26, 28 overall form a working face the curvature of which is slightly smaller than the curvature of the lateral face of the tooth 52.

Small abrasive particles 61 have been twisted into some of the cleaning elements 26 and 28, which particles are shown on an exaggerated scale in the drawing and are released as the cleaning elements untwist.

Alternatively, small abrasive particles can be introduced into the pile formed by the cleaning elements 26, 28 by keeping the teeth cleaning implement, between teeth cleaning sessions, in a solution in which fine particles of that kind (for example pyrogenic silica particles) are suspended.

Such fine abrasive particles are used when thick, hard deposits or stubborn discoloration are to be removed.

Since the individual filaments 48 obtained by unravelling the ends of the cleaning elements 28 and 60 have a very small diameter, they are also able to penetrate into fine depressions in the surface relief of the tooth 52 and mechanically remove any contamination present there. In many cases, therefore, when using such a teeth cleaning implement it is sufficient to wet the tooth surface with water which, by dipping the cleaning implement in water, is held in the spaces between the various cleaning elements. The water held in the pile formed by the cleaning elements serves at the same time as a transport medium in which detached contaminants are able to move from the tips of the cleaning elements into the interior of the pile. The contaminants are then washed out of the pile when the cleaning head is cleaned after cleaning the teeth or denture.

If desired, however, it is also possible to use in addition a liquid treatment medium containing deodorants, flavourings (for example mint) and active ingredients (for example fluorides, chlorhexidine digluconate, enzymes or the like). That treatment medium 62 may be dispensed, for example, from a dropping bottle 64. Instead of using such a liquid, it is also possible to use a gel with corresponding additives, which accordingly corresponds to a toothpaste without abrasive particles and is used analogously.

Figure 7:
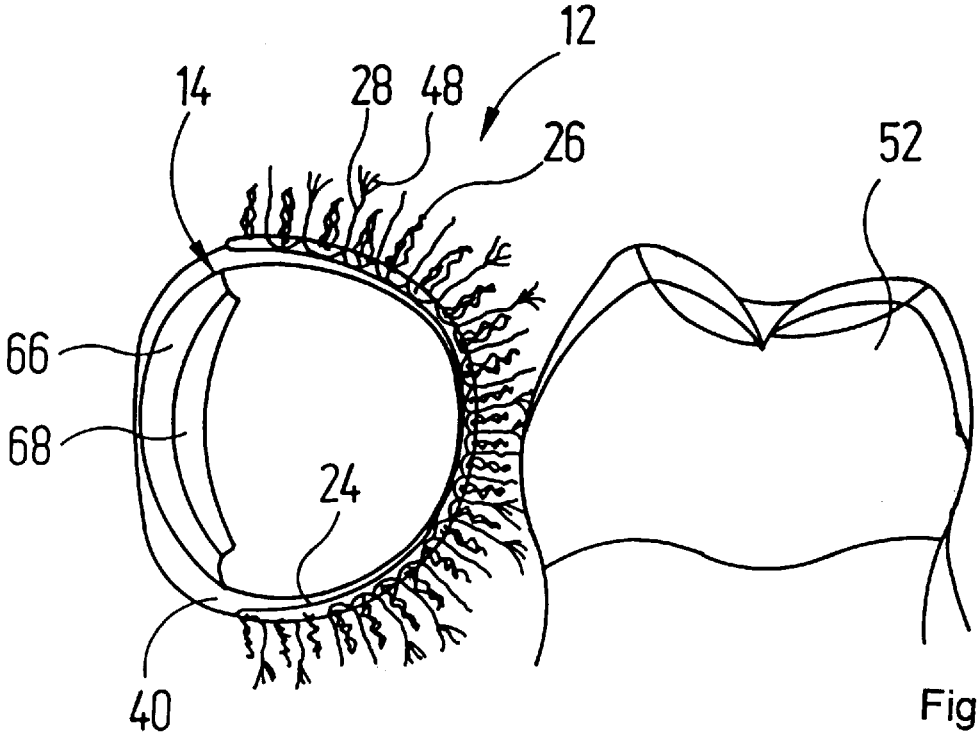
FIG. 7: is a view similar to FIG. 5, with yet another embodiment of a teeth cleaning implement.

The teeth cleaning implement shown in FIG. 7 is comparable in its general structure to the teeth cleaning implement shown in FIGS. 4A and 4B, with the difference that the head body 14 has a convex working side and is higher than the head body shown in FIGS. 4A and 4B. Since the reinforcing foam layer 40 has in this case, however, only a very small wall thickness over a large forward region, the head body 14 shown in FIG. 7 is able to deform easily and thus conform to the outer contour of the tooth 52.

As will be seen from FIG. 7, the rear half of the tubular base member 24 is also embedded in the forward portion of the foam layer 40, which foam layer accordingly forms on its own the rear side of the head body 14.

Also attached to the inside of the tubular head body 14 are a first resilient layer 66 and a second resilient layer 68. The layer 68 is softer than the layer 66 and has a forward boundary surface that is less curved than the forward boundary surface of the layer 66. The layers 66 and 68 form a progressive elastomeric block spring which, when the cleaning head 12 is pressed hard against the tooth 52, comes to rest on the rear side of the base member 24 reinforced by the thin portion of the foam layer 40. In that manner, a resilient yet strong non-positive connection is obtained between the cleaning head 12 and the lateral face of the tooth.

Figure 8:
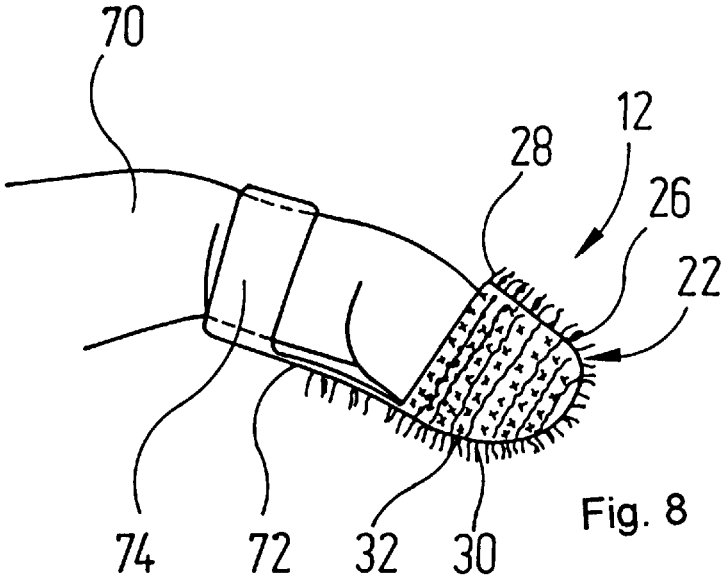
FIG. 8: is a schematic side view of a teeth cleaning implement placed on a finger.

In the case of the cleaning implement shown in FIG. 8, the cleaning head 12 is in the form of a finger cap which can be pushed over the finger 70 of a user. A resilient clamping portion 74 for detachably fastening the cleaning head 12 to the finger of the user is integrally formed on the cleaning head 12 via a connecting piece 72 which is likewise fitted with cleaning elements.

Alternatively, for fastening the cleaning head 12 to the finger, a portion of the finger cap can be replaced by elastic so that the finger cap sits on the end of the finger under elastic circumferential tension.

Figure 9:
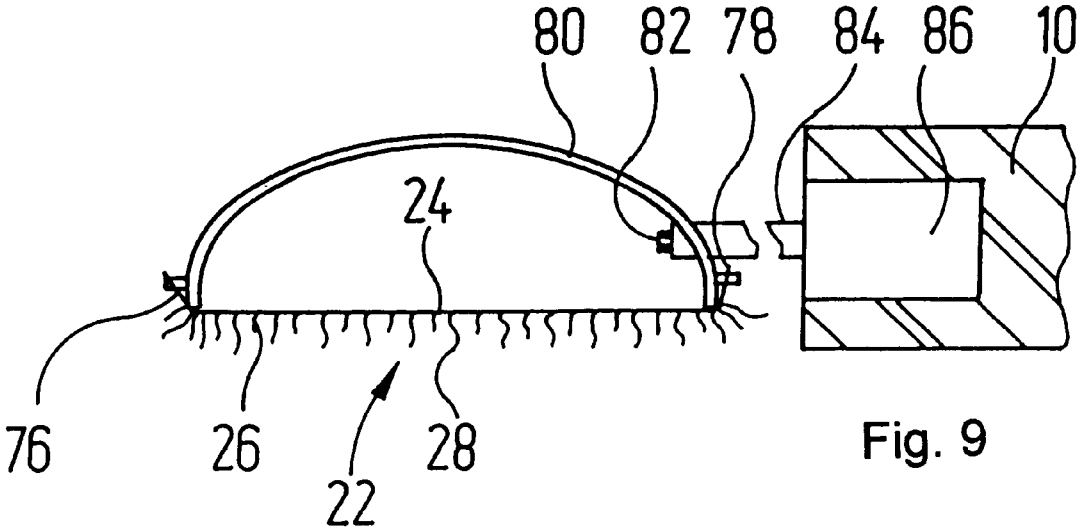
FIG. 9: shows a schematic longitudinal section through a further modified teeth cleaning implement that has a vibration drive.

In the case of the teeth cleaning implement shown in FIG. 9, the base member 24 which carries the cleaning elements 26, 28 is provided at its ends with fastening elements 76, 78 shown as eyelets. The latter are suspended under bias in a C-shaped plate spring 80 so that the plate spring 80 stretches the flexible base member body 24 flat.

The plate spring 80 is in turn detachably joined (for example by a screw 82), at a point adjoining one end thereof, to the power take-off part 84 of a vibrator, designated 86 in its entirety, which is integrated into the handle 10. The vibrator 86 operates at a frequency in the range of from 50 to 1000 Hz, preferably from 100 to 300 Hz, the amplitude A of the power take-off part 84 being in the range of from 1 μm to 1000 μm, preferably from 200 μm to 500 μm. The base member 24 carrying the cleaning elements 26, 28 is thus moved to and fro by the vibrator 86, the main component of that movement extending parallel to the axis of the handle. When pressed against the surface of a tooth, the base member 24 is able to conform to the tooth surface with resilient deformation of the plate spring. A small proportion of the driven movement of the vibrator 86 then becomes effective also in the direction perpendicular to the tooth surface.

Instead of using the vibrator 86, it is also possible to use an ultrasound generator. To produce a slow reciprocating motion, which may also be superimposed by other, for example gyratory, movements, the shackle 80 can also be coupled to the power take-off part of a conventional electric toothbrush drive.

It is generally true of all the cleaning heads discussed in this description and shown in the drawings that they can be used as desired for purely manual tooth surface cleaning and for mechanically assisted tooth surface cleaning. In the former case they are joined to a conventional toothbrush handle, in the latter case they are caused to oscillate by a drive which may in turn be guided manually in addition.

The following correlations between the frequency and the amplitude of the movement mechanically imposed on the cleaning head have proved especially favourable:

| frequency f (Hz) | amplitude (μm) |
|---|---|
| 50 to 500 | 50 to 700 |
| 1000 to 10,000 | 10 to 400 |
| 17,000 to 30,000 | 5 to 70 |

In the case of the teeth cleaning implement shown in FIGS. 10A and 10B and 11, the base member 24 is impregnated with a resilient material 90 and permanently shaped into a geometry resembling the toe of a shoe. Lateral edges of the shaped base member 24 are seated in slots 91 in a head plate 92 which is in turn fitted and clipped into a suitably matched end portion 93 of a handle.

The thickness and hardness of the material 90 impregnating the base member is so selected that, under the pressing force customary for cleaning teeth, the upper face, in FIG. 11, of the base member is curved in a concave manner in accordance with the average curvature of the tooth face being treated.

As will be seen from FIGS. 10A and 10B and 11, the head plate 92 has an edge wall 92-1 extending all round it which fits into an edge wall 93-1 extending all round the holding portion 93. A fastening pin 92-2 of the head plate 92 is engaged by a fastening aperture 93-2 in the holding portion 93 in a frictional connection and/or by a catch arrangement.

Figure 12:
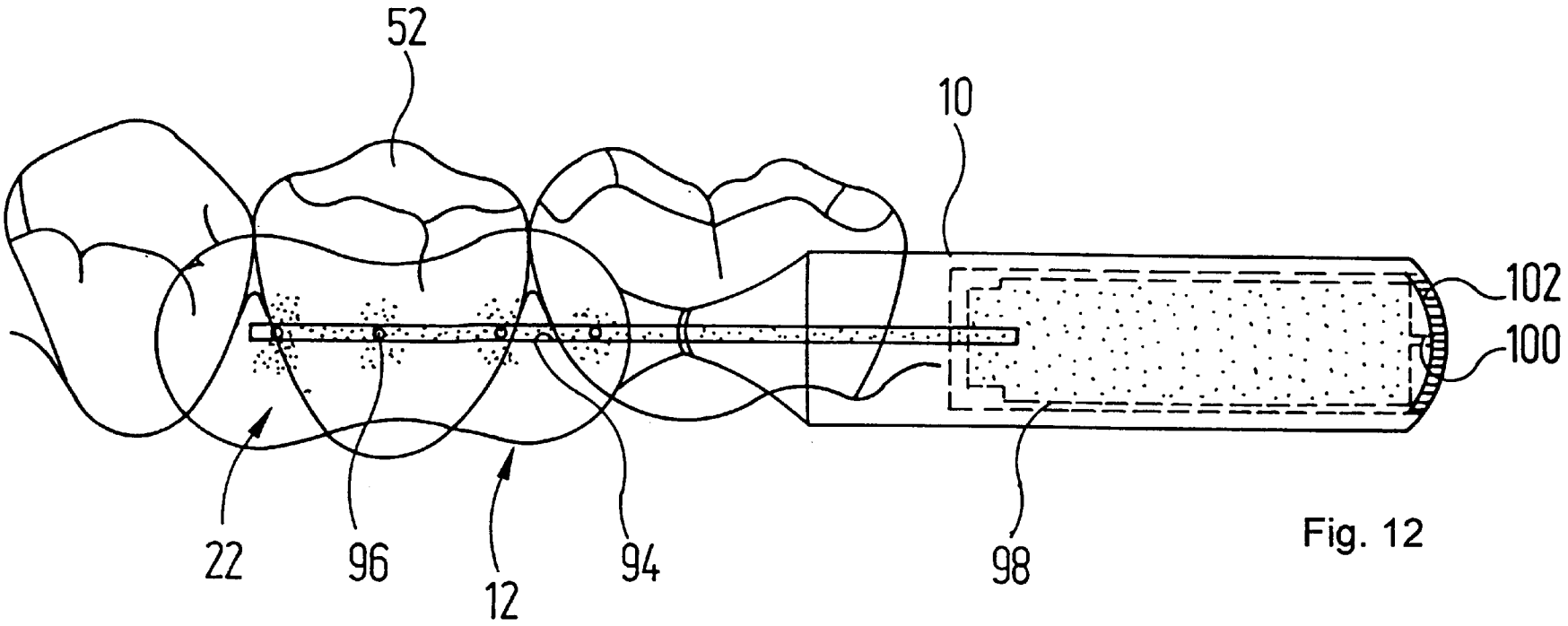
FIG. 12: is a schematic side view of a further teeth cleaning implement with treatment liquid being supplied to the working face.

The teeth cleaning implement shown in FIG. 12 substantially corresponds to that shown in FIGS. 1A to 1C, but with a liquid channel 94 being provided in the head body 14. The liquid channel 94 has on its front side a plurality of openings 96 through which a treatment liquid can be passed through the base member 24, which is of a liquid-permeable construction, into the spaces between the cleaning elements 26, 28 in order to pass from there to the working face of the cleaning head 12.

The liquid channel 94 is connected to a reservoir 98 for the treatment liquid, which is housed inside the handle 10 and is connected to the surrounding atmosphere via a ventilation opening 100. By shaking the handle 10 a small amount of treatment liquid can be moved through the openings 96.

The treatment liquid may, for example, contain fluorides or other active ingredients and/or plaque-staining agents and/or flavourings and/or small abrasive particles. The cartridge-like reservoir 98 can be replaced after removing the cover 102 provided at the end of the handle.

FIG. 13 shows various examples for the production of a base member carrying cleaning elements:

At a), threads 104 are sewn or tufted into a textile base member 24 in such a way that loops 106 which project above the front side of the base member 24 are obtained. End portions of the loops 106 are cut off so that each loop then forms two cleaning elements 28 (or 26).

If the threads 104 are twisted multifilament threads, the free end portion of the cleaning elements can be unravelled so that a tuft of individual filaments 48 is obtained.

The production method shown at d) largely corresponds to that at a), but the loops 106 are portions of the warp and/or weft threads of the woven fabric forming the base member 24, which portions have been drawn out of the plane of the base member. This can be done, for example, in the form of a knitted velour.

In the case of the production method shown at b), individual monofilament cleaning elements 110 which have been chemically split at their ends into several small monofilaments 108 are inserted into the meshes of the woven base member 24 and fixed in position by small amounts of adhesive 112.

It will be appreciated that the aforementioned variants for fixing the cleaning elements to the base member can each be used in the same way for monofilament and multifilament cleaning elements and for untreated (for example not split or not unravelled) cleaning elements and treated (for example textured) cleaning elements.

Finally, at c), a fine weave 114 of a weldable plastics material such as propylene is laid in folds (folds extend perpendicular to the plane of the drawing), and the lowermost points, in FIG. 13, of the folds are joined by welds 116 to the base member 24 which is similarly produced from a weldable plastics material such as polypropylene. After joining the weldable weave 114 to the weldable base member 24, the upper end portions 118 of the weave folds are then cut off and, in that manner, a very large number of individual cleaning elements of small diameter (warp or weft threads of the fine weave 114) are obtained which, however, are very effectively protected against microbending since they are held in frictional engagement by adjacent threads of the weave extending perpendicular to them. Macroscopically, the cut-off ends of the folds of the weave 114 again produce a working face that is able to conform to the macrocontour of the surface of a tooth.

The cleaning elements may each be provided with a coating in order to influence their surface qualities. This is shown for the case of a monofilament cleaning element in FIG. 14 (coating 120).

The coating material may either be one that contains antimycotic or antibacterial active ingredients or one that includes a material that improves resistance to wear, such as a silicic acid preparation. If desired, small abrasive particles may also be incorporated into the coating. Other coating materials that come into consideration are silanes and silicones or synthetic resins.

FIGS. 15A and 15B shows an example for modifying the properties of a cleaning element the basic structure of which is a thread with individual filaments 122. It is possible to impregnate into the loose thread structure a matrix material 124 which may comprise the various material components discussed in connection with the coating 120, individually or in combination. As a result of the matrix material 124, obviously also the mechanical strength, especially the flexibility, of the cleaning element, is modified in a targeted way.

In the case of the illustrative embodiment shown in FIG. 16, small abrasive particles 126 have been embedded in a monofilament cleaning element made from a material that wears away. As the teeth cleaning element is used, those abrasive particles are then successively exposed in order, for example, to remove stubborn deposits from the tooth surface.

Figure 17:
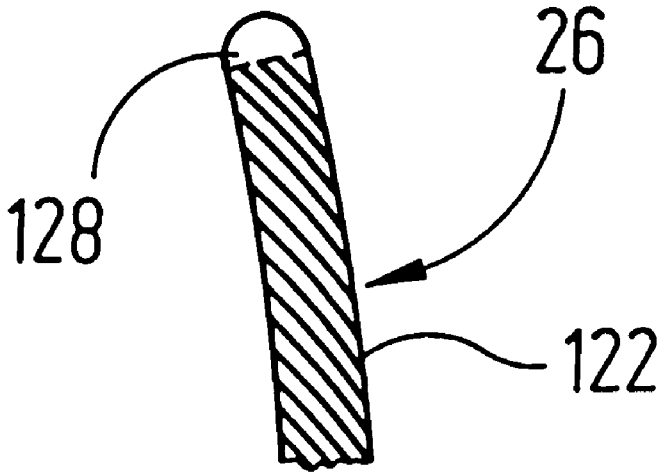
FIG. 17: is an enlarged side view of the end of a further modified cleaning element.

FIG. 17 shows the free end portion of a further cleaning element, which is made from a multifilament thread consisting of a weldable plastics material such as polyester. By melting the end of the cleaning element, a solid, hemispherical end cap 128 has been obtained. With such a cleaning element it is not possible to fan open the individual filaments.

Figure 18:
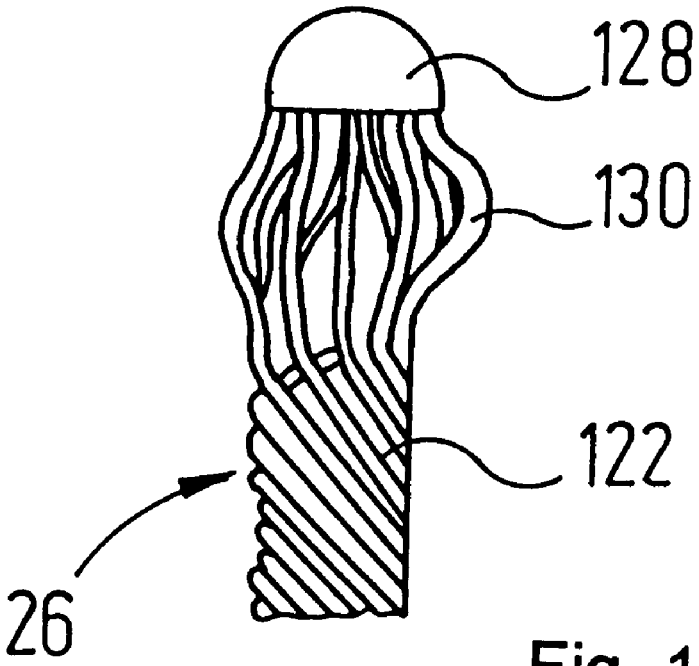
FIG. 18: is again an enlarged side view of a further modified cleaning element that can be produced from that shown in FIG. 17.

If desired, the solid end cap 128 can have a somewhat softer support by untwisting the end of the thread by applying a relatively high force, as shown in FIG. 18. The end cap 128 is then connected to the main part of the cleaning element by way of a plurality of small curved filament portions 130.

Figure 19:
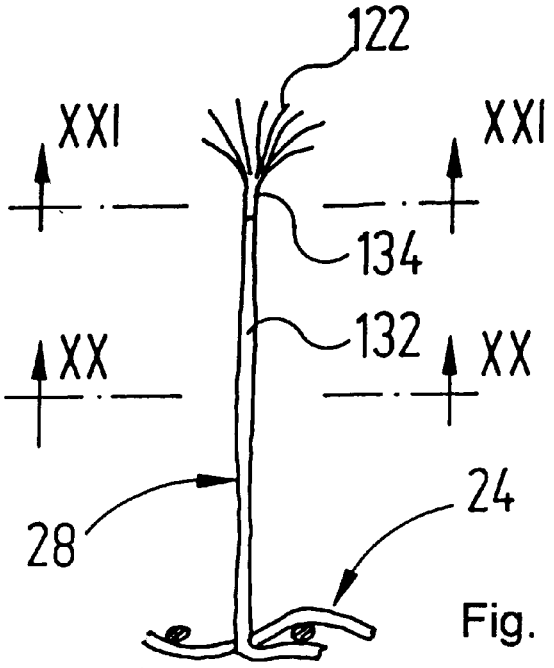
FIG. 19: is a side view of a cleaning element that has been partially stiffened by impregnation with resin.
Figure 20:
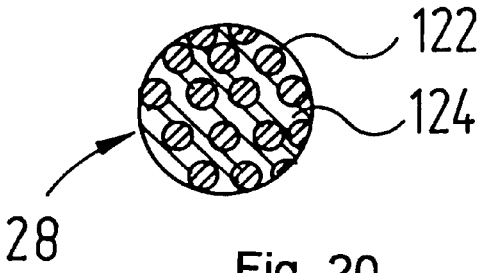
FIG. 20: shows a transverse section through the cleaning element according to FIG. 19, along the line of section XX—XX therein.
Figure 21:
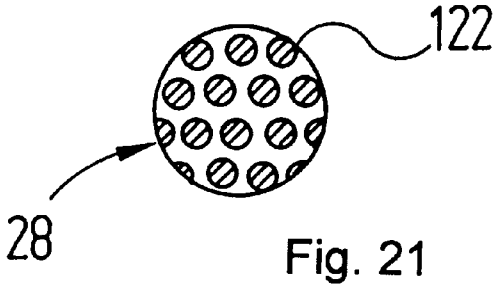
FIG. 21: shows a transverse section through the cleaning element according to FIG. 19, along the line of section XXI—XXI therein.

FIGS. 19 to 21 show that the stiffness of a cleaning element 28 (or other multifilament cleaning elements) can be increased by impregnating a lower main portion 132 with a synthetic resin 124 that increases the stiffness, while leaving a short end portion 134 unimpregnated. The latter is then unravelled for the most part.

Alternatively, after the end portion 134 has been unravelled into individual filaments it can also be impregnated with the same synthetic resin or with a synthetic resin having a different strength, it being possible for this to be restricted to the part of the end portion 134 that has not been unravelled or for the individual filaments to be coated with a coating simultaneously in order to increase the stiffness as far as their end face. With this variant, the section along the line XXI—XXI then appears similar to the section shown in FIG. 20 but the synthetic resin 124 may be a different synthetic resin.

To stiffen monofilament cleaning elements they can be coated in portions with synthetic resin, the procedure being analogous to the impregnation of multifilament cleaning elements described above.

Figure 22:
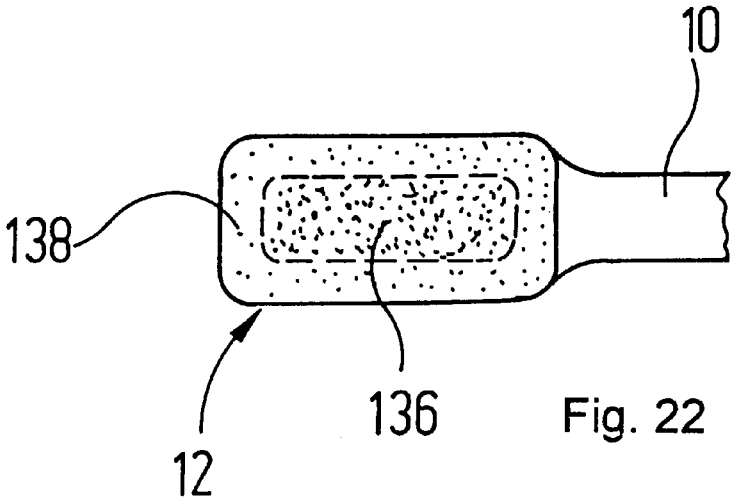
FIG. 22: is a plan view of the working face of a modified teeth cleaning implement.

In the case of the cleaning head 12 shown in FIG. 22, there is a central region 136 of cleaning elements 26 and 28 of a first mean length and a first, high density, that is to say with a small spacing between the cleaning elements, and an edge region 138 having cleaning elements that are on average longer and softer and have a second, lower density, it also being possible for the distribution between cleaning elements 26 and 28 to be different and, in addition, for the cleaning elements or a part thereof to be made from a different material.

Figure 23A:
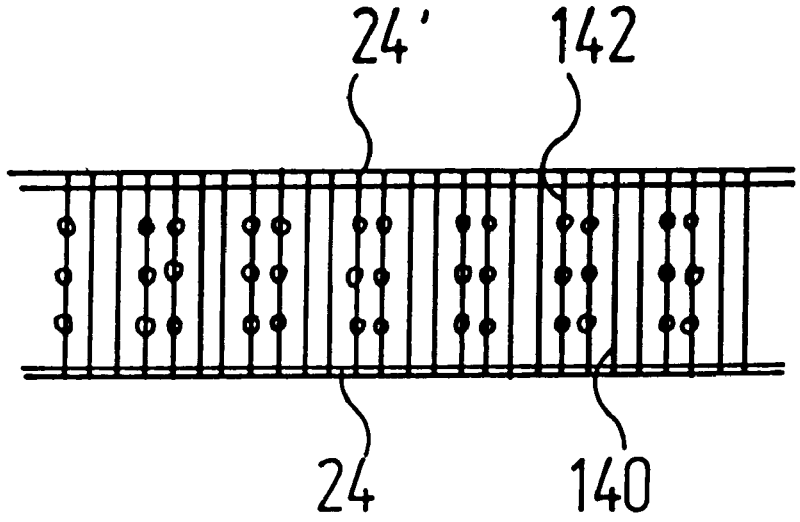
FIG. 23: shows various steps in the production of a teeth cleaning material using strips of cleaning elements of different heights.
Figure 23B:
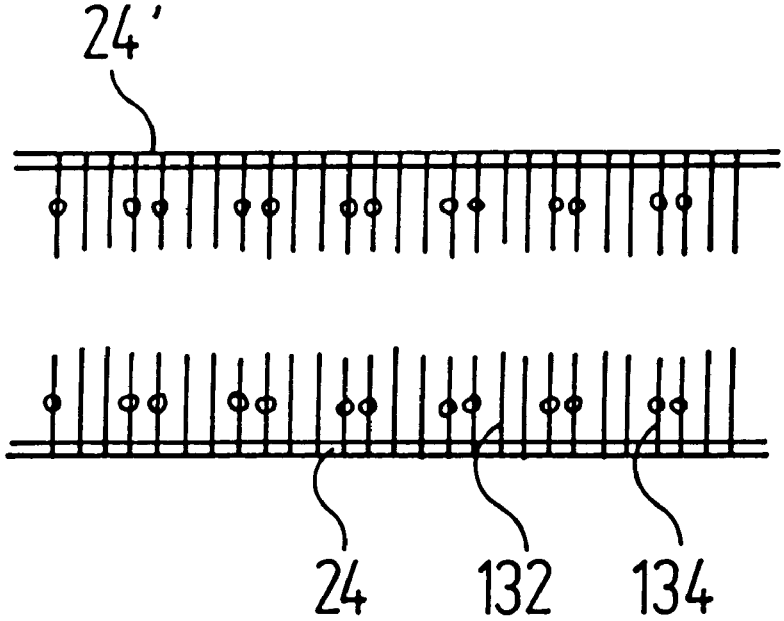
Figure 23C:
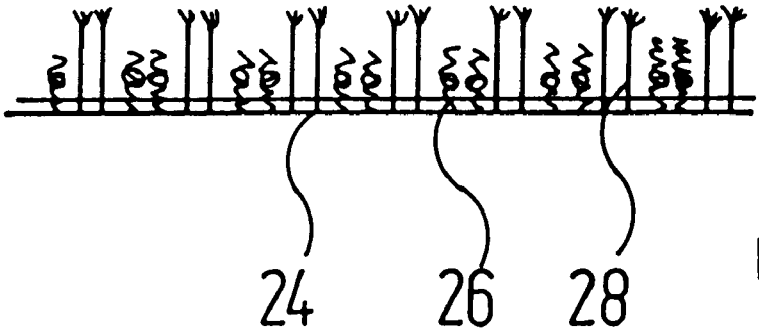

In the partial Figures a), b) and c) of FIG. 23 successive steps in the production of an endless velvet-like or velour-like material are shown, as may be used for the production of a cleaning cover 22.

First, threads 140 and 142 are sewn between two base member 24, 24' which are held apart. The threads 140, which are later to form cleaning elements 28, are shown as single lines. They are twisted multifilament threads or monofilament threads the ends of which can be split by chemical action. The threads 142, which are later to provide the textured, crimped cleaning elements 26, are marked by small circles (those circular marks do not, therefore, illustrate the geometry of the threads). The threads 142 have been pretreated in such a way that they can subsequently be made to curl by physical and/or chemical treatment. They may, for example, be threads having a frozen-in stretch. As will be seen from the drawing, in each row of threads, two threads 140 always follow two threads 142.

The double weave shown in partial Figure a) is then cut in the middle with a knife so that two separate base member bodies 24 and 24' are obtained, each of which carries an associated set of pile fibres as shown in partial Figure b). By impregnating the base member 24, 24' with a synthetic resin and then curing the synthetic resin the pile fibres are permanently fastened to the base member.

Subsequently, the base member 24 and 24' carrying pile threads of equal length but of different characteristics are then subjected, together with their pile threads, to a physical and/or chemical treatment which results in the thread pieces 142 adopting a crimped structure and the ends of the thread pieces 140 untwisting. The material so obtained, in which two short, crimped cleaning elements 26 in each case follow two long cleaning elements 28 that are split into individual filaments at their ends, is shown in partial Figure c) of FIG. 19.

A material that is just as well suited as a cleaning material is a knitted velour with pile loops or pile threads forming corresponding cleaning elements.

Pieces of material separated from such a material can be used for cleaning teeth or denture materials directly or after being shaped.

The following applies equally to the above-described illustrative embodiments with regard to choice of material, geometry and mechanical properties:

The base member 24 consists of any desired flexible structure to which cleaning elements are attached in such a way that they extend away from the main face of the base member, preferably in a direction perpendicular thereto. Such structures are, especially, woven fabrics, knitted fabrics, nonwoven fabrics, felts, or composite materials made from the afore-mentioned materials.

With regard to the (optionally different) basic materials from which the base member 24 and the cleaning elements 26, 28 and other cleaning elements are made, they are, in principle, biologically tolerable, toxicologically safe (also with regard to any wear) materials that withstand the intraoral environment. In particular, any constituents of a toxicologically harmful length/width ratio must not be contained in them or produced during use.

A further general requirement of the materials used is resistance to wear and low solubility in the oral environment, especially in organic acids.

Especially suitable are mineral fibres and man-made fibres consisting of natural polymers, such as cellulose or albumen, or of synthetic polymers, especially polyamide, polyacrylic, polypropylene, polyurethane, polyvinyl chloride, polystyrene, polysulfone and, especially preferably, polyester.

Other materials for the fibres of which the base member 24 is composed are also vegetable fibres such as cotton, flax, linen, and animal fibres such as wool or silk.

The wear resistance of the cleaning elements can be improved by impregnation with silicic acid preparations. For reasons of hygiene, coating or impregnation with antimycotic or antibacterial active ingredients is advantageous.

Where abrasive particles are referred to in the present description, it is especially pyrogenic silica particles that are meant.

As far as the geometry of the cleaning elements is concerned, they normally have a circular transverse cross-section. For special cases, however, polygonal thread cross-sections, for example a triangular thread cross-section, may be advantageous, for example if an additional cleaning action by longitudinal sides of the cleaning elements is desired.

The cleaning elements can be textured, for example crimped and/or electrostatically charged, before or after being incorporated into the base member. In addition, at least on portions of their surface they may be restructured or conditioned, i.e. modified in terms of their surface characteristics. Physical or chemical processes have been found useful here. In particular, provision is made for the surfaces of the cleaning elements to be treated mechanically, for example brushed or ground with emery, to roughen the surfaces at least partially. Furthermore, the cleaning elements can be thermally treated, at least in portions thereof, for example to create dome-shaped closed fibre ends or to obtain secondary and/or tertiary fibre structures, for example tangled or crimped structures. By irradiation, for example with gamma rays, the cleaning elements or the cleaning head as a whole can be sterilised and the free surface energy of the cleaning elements can be increased and their zeta potential can be altered, with improves the cleaning action of the teeth cleaning implement. By chemical conditioning methods also, for example treatment with solvents, acids or alkalis, specific changes can be made to the cleaning elements, for example individual filaments or entire cleaning elements can be welded at least partially, the surface of the cleaning elements can be roughened or ends of monofilament cleaning elements can be split.

If the surfaces of the cleaning elements are coated at least partially, for example with silanes and/or silicones and/or synthetic resins, or if thread-like cleaning elements consisting of a plurality of individual filaments or a cleaning cover made up of such cleaning elements is impregnated at least partially with materials of the same kind or of a different kind, preferably synthetic resins, a targeted stiffening of individual portions of the cleaning elements or a joining together of several adjacent cleaning elements can be achieved. If the selected coating or impregnating materials are different, the risk of agglomeration of fine individual filaments of a cleaning element can be reduced.

It will be appreciated that the cleaning elements can also be conditioned and/or coated and/or impregnated differently in different portions.

Attachment of the cleaning elements to the base member is essentially carried out in such a way that the cleaning elements extend away from the base member substantially perpendicularly, similarly to pile fibres attached to carrier weaves. The cleaning elements may, however, also be arranged at a different given angle to the face of the base member.

The individual cleaning elements may, as described above, be formed by individual loops of thread which, after being cut, form a pile of open pile threads. The loops are preferably attached to the base member in such a way that only the cleaning side of the cleaning cover 22, and not its reverse side, has projecting fibres. Alternatively, the cleaning cover may also be produced from a double weave or a three-dimensional weave of textile fibres or threads in which free fibre ends are created by cuts.

Fixing of the cleaning elements to the base member is effected most easily by impregnating the base member and/or the bottom portion of the cleaning element with a synthetic resin. Instead of or in addition to such an adhesive bond, the base member carrying the cleaning elements may be coated at least partially with, for example, a compact foam.

The cleaning cover may be fastened to a backing, which is a foil or a planar piece of material, preferably of plastics or metal, which then serves at the same time as a holding element for the cleaning cover, either by being part of a handle or by serving as a fastening element for permanent or detachable connection to a separate handle.

For the production of the cleaning cover 22 there are preferably used monofilament fibres and multifilament fibres of twisted individual filaments which preferably consist of polyester.

If monofilament fibres are used, the selected diameter thereof is from 1 $\mu$m to 500 $\mu$m, monofilament fibres having an average diameter of from 1 $\mu$m to 100 $\mu$m, and more preferably in the range of from 1 $\mu$m to 50 $\mu$m, having proved successful. It will be appreciated that it is also possible to use fibres that do not have a constant fibre diameter, especially conical fibres which have a diameter in the ranges mentioned above only in their free end portion.

If multifilament fibres are used, the average diameter thereof will be from 5 $\mu$m to 1000 $\mu$m, diameters of from 10 $\mu$m to 500 $\mu$m and especially from 30 $\mu$m to 300 $\mu$m having proved especially successful. It has proved especially successful to select the diameter of the individual filaments of those fibres to be from one tenth to one five-hundredth of the fibre diameter, more preferably from one twentieth to one hundredth of the fibre diameter.

The planar base member preferably consists of a base weave made from a base fibre. At least one pile fibre is worked into the base weave in such a way that pile loops project above that surface of the base weave which later serves as the cleaning side, while the pile fibres on the future reverse side of the base weave are incorporated without any projection of fibres. The projecting pile loops are thereafter cut open so that a unilateral pile is produced.

Also very suitable is a base member in the form of knit with unilaterally projecting loops which are cut open, for example in the manner of a knitted velour.

Special preference is given to a multifilament pile fibre which, at the cut ends of the fibres, fans out into a plurality of small individual filaments. That substantially increases the overall surface which is active in the cleaning operation. With a size of cleaning cover 22 comparable to the dimensions of the bristle area of a conventional toothbrush, the pile formed by the cleaning elements, optionally with a pre-curved shape of the cleaning face in addition, enables a safe distance to be kept between the cover and the spherically curved buccal and oral tooth surfaces and from wide parts of the approximal and occlusal tooth surfaces and in the region of the gingival sulcus.

Fibre projections of the pile loops and/or pile fibres starting at the level of the base weave of from 0.5 mm to 15 mm, preferably from 2 mm to 10 mm and especially preferably from 4 mm to 8 mm have proved successful, a value of about 8 mm being most preferred.

Preferably, the chosen height of the pile is not uniform; rather, different projecting heights of uncut pile loops and/or of pile fibres cut open to produce a pile will be selected in different regions of the cleaning side of the cleaning cover 22. There have proved especially successful in this connection mixed surface structures with locally regular geometries, for example strip-shaped arrangements of cleaning elements which are oriented differently in different regions of the cleaning face, for example in the longitudinal direction and transverse direction of the cleaning head.

There have proved especially successful those geometries in which every second lane of pile loops and/or of pile fibres has a difference in the projecting height of the fibres from the respectively adjacent lane of from 0.5 mm to 5 mm, preferably from 1 mm to 3 mm.

If the cleaning elements of different heights are produced as described above with reference to FIG. 19, the cleaning elements 26 and 28 not only are of different lengths but also have different strengths and different textures, and they can also consist of different basic materials.

It has also proved successful to provide a greater projecting height of the pile loops and/or of the open pile fibres in the edge regions of the cleaning cover 22 than in central regions of the cleaning cover. A substantial improvement in the cleaning of the approximal tooth surfaces and the gingival sulcus is thereby obtained.

The cleaning action of the cleaning cover 22 can be further improved by integrating a further pile fibre into the base weave in addition to the pile fibre already discussed above. The projection of that further pile fibre points in the same direction as that of the first pile fibre, the reverse side of the cleaning cover 22 preferably having no projecting fibres even after the second pile fibre has been inserted. The resulting pile loops of the second pile fibre preferably remain uncut in the case of monofilament fibres. Especially suitable as the second pile fibre is a multifilament fibre the loops of which are likewise cut open at the ends.

There is preferably used for the second pile fibre a monofilament fibre that has been textured to give a crimping of the fibre. By selective texturing of the second pile fibre (for example use of material that has been modified in comparison with the first pile fibre and which is resiliently prestressed or is more sensitive than the first pile fibre to chemical and/or physical conditioning processes, especially texturing, a crimping of the second pile fibres is obtained so that the latter, especially in the case of multifilament fibres, partly tangle with one another slightly.

It has proved especially successful to provide the second pile fibre between two lanes of first pile fibres since, in that way, the pile formed by the first pile fibre is stabilised and early bending-over of the opened projecting length of the first pile fibres during teeth cleaning is avoided. The projecting height of the second pile loops and/or of the second opened pile fibres can be the same as or greater or less than that of the first pile fibres. A projecting height of the second pile fibres that is less than that of the first pile fibre by a maximum of 5 mm, and preferably by from 0.5 mm to 2 mm, has proved especially successful.

In addition, third and even more pile fibres or also conventional bristles can be attached to the base weave. If bristles are used, they may also be worked into the base weave in place of the second pile fibres discussed above. If conventional bristles are used in addition, then a difference in the projecting height of approximately from −5 mm to +5 mm relative to the projecting height of one of the pile fibres, preferably the first pile fibre, is preferably provided for them. The bristles can be fastened either to the base weave or to an adjacent surface portion of a head body or handle element. Preferably, bristles that are from 0.5 mm to 2 mm shorter than the projecting height of the pile fibres or pile loops are inserted between two lanes of pile fibres or pile loops.

In order to improve the cleaning of the approximal tooth surfaces, a fibre resembling a twisted yarn and having a structure resembling a spring can be arranged at the longitudinal edge regions of the cleaning cover 22. The individual spring-like loops are then able to penetrate far into the interdental spaces in the course of teeth cleaning by longitudinally parallel movement of the cleaning head relative to the rows of teeth.

Preferably, the working or cleaning face of the cleaning head formed by the cleaning elements is given a concave transverse cross-sectional shape. In addition, the longitudinal cross-sectional shape of the cleaning face may also be selected to be concave. Advantageous radii of curvature of the cleaning face are produced by observing the mean curvature of the tooth crowns or of the rows of teeth in the corresponding planes.

The length of the cleaning cover 22 is selected with a view to the average width of two to three adjacent teeth, while the width of the cleaning cover 22 corresponds substantially to the average height of a tooth crown. A typical cleaning cover will have in practice a length of from 15 to 30 mm and a height of from 5 to 15 mm, preferably a length of 20 mm and a height of 10 mm.

By giving the edge region of the cleaning cover 22 a garland-shaped form improved cleaning of the approximal surfaces of the teeth and the gingival sulcus is obtained.

As will be apparent from the above description of illustrative embodiments, it is important for the cleaning elements to have a certain stiffness and also as small a diameter as possible in order to be able to clean also depressions in the fine surface relief of the teeth surfaces. The surface hardness of the cleaning elements used should be slightly greater than the surface hardness of the organic plaque structure so that organic plaque can be removed. It is especially advantageous if the surface hardness of the cleaning elements is selected to be slightly greater than the surface hardness of plaque that has calcified in the way that occurs when tartar formation begins. To avoid wear of healthy hard tooth tissue and customary tooth restoration materials, however, the surface hardness of the cleaning elements is selected to be less than that of the hard tooth tissue or the restoration materials.

In a given material, it is furthermore possible to vary the strength of the cleaning action by way of the extent of projection of the cleaning elements and to combine harder and softer cleaning elements of different projecting heights.

A teeth cleaning implement of the kind described above with reference to various illustrative embodiments has, because of its fibre structure, a substantially larger active cleaning area in comparison with conventional toothbrushes, the substantially smaller diameter of the active ends of the cleaning elements compared with conventional bristles making possible an improved cleaning of microscopic surface structures. As a result, the contact time between the cleaning head 12 and the tooth surface required for cleaning can be substantially reduced in comparison with conventional cleaning techniques (use of a toothbrush and toothpaste). Owing to the improved cleaning action, good results can be obtained also with less refined cleaning techniques, it being possible to choose in virtually any desired way the contact between the cleaning head 12 and the tooth face to be cleaned. In particular, good results are also obtained with the described teeth cleaning implement when removing smoking deposits or tea deposits from the surfaces of teeth or denture materials.

Owing to the only small dimensions of the ends of the cleaning elements which are active in the cleaning, in order to reduce the surface tension of the surfaces to be cleaned it is sufficient to wet the same and the cleaning elements with water or saliva. The use of cleaning pastes or cleaning solutions, which possibly contain surfactants or other additives that are harmful to health, can be dispensed with. Nor is the use of suspensions of abrasive particles after the fashion of a toothpaste necessary.

A teeth cleaning implement of the kind described above is simply cleaned under running water after use and stored dry in the surrounding atmosphere. Instead, for cleaning and/or storage a treatment liquid may be chosen, for example a silicic acid gel or a fluoride- or chlorhexidine-containing solution. In that manner, agglomeration of the fibres is prevented, with simultaneous disinfection. In addition, while being stored until the next use, the cleaning head can be impregnated with active ingredients or with fine abrasive particles from that treatment liquid and/or be chemically conditioned to maintain its cleaning efficiency.

The invention claimed is:

1. A material for cleaning surfaces of teeth and denture materials, comprising a base member (24) and a plurality of cleaning elements (26, 28, 34, 58, 60, 100) carried by the base member (24), which cleaning elements have small transverse dimensions compared with their length, characterized in that the base member (24) is a flexible, bendable structure and the cleaning elements (26, 28, 34, 58, 60, 100) are carried by the base member (24) in the manner of a pile loops or pile threads and at least some of the cleaning elements comprise monofilaments having a diameter of from about 1 $\mu$m to 500 $\mu$m.

2. The material according to claim 1, characterised in that end portions of the monofilament cleaning elements (110) are split (108).

3. The material according to claim 1, characterised in that at least some of the cleaning elements (26, 28, 34, 58, 60) are multifilament fibres.

4. The material according to claim 3, characterised in that in end portions (128) of at least some of the multifilament cleaning elements (26, 28) the individual filaments (122) are joined to one another.

5. The material according to claim 4, characterised in that the individual filaments of the fibres in the vicinity of the end portion (128) in which the individual filaments (122) are joined to one another are separated from one another and form resilient filament portions (130).

6. The material according to claim 3, characterised in that in end portions of the cleaning elements (26, 28) the individual filaments form a filament tuft (48).

7. The material according to claim 3, characterised in that the diameter of the multifilament cleaning elements (26, 28) is from 10 $\mu$m to 1000 $\mu$m.

8. The material according to claim 3, characterised in that the diameter of the individual filaments is smaller than the diameter of the cleaning elements by a factor of from 10 to 500.

9. The material as in claim 8, characterized in that the diameter of the individual filaments is smaller that the diameter of the cleaning elements by a factor of from 20 to 100.

10. The material according to claim 1, characterised in that at least some of the cleaning elements (26, 28, 110) have a basic structure (124; 110) that is abrasive or that opens in use and have abrasive particles (61; 126) that are carried by the basic structure (124; 110).

11. The material according claim 1, characterised in that at least some (34) of the cleaning elements (26, 28, 34, 58, 60) are helical or garland-shaped.

12. The material according to of claim 1, characterised in that among the cleaning elements (26, 28, 34, 58, 60, 110) there are those (26) of a first length and those (28) of a second length.

13. The material according to claim 12, characterised in that the cleaning elements (26) of the first length and the cleaning elements (28) of the second length are arranged in interspersed strip-shaped regions (30, 32).

14. The material according to claim 3, characterized in that sub-areas (36, 38) of the foundation body (24) are fitted with strips of cleaning elements (26, 28), which strips are of different heights and are oriented in different directions.

15. The material according to claim 14 characterized in that the strips are oriented perpendicular to each other.

16. The material according to claim 1, characterised in that the number of cleaning elements (26, 28, 34, 58, 60, 110) per unit of area is different in different regions (136, 138) of the material.

17. The material according to claim 1, characterised in that the projecting height of the cleaning elements (26, 28, 34, 58, 60, 110) above the base member (24) is from 0.5 to 15 mm.

18. The material according to claim 17, characterized in that the height of the cleaning elements (26, 28, 34, 58, 60, 110) above the base member (24) is from 2 to 10 mm.

19. The material according to claim 18, characterized in that the projecting height of the cleaning elements (26, 28, 34, 58, 60, 110) above the base member (24) is from 4 to 8 mm.

20. The material according to claim 19, characterized in that the projecting height of the cleaning elements (26, 28, 34, 58, 60, 110) above the base member (24) is approximately 8 mm.

21. The material according to claim 1, characterised in that at least some (26) of the cleaning elements (26, 28, 34, 58, 60, 110) are textured.

22. The material according to claim 1, characterised in that the surface of at least a part of the cleaning elements (26, 28, 34, 58, 60, 110) is at least partially roughened.

23. The material according to claim 1, characterised in that the cleaning elements (26, 28, 34, 58, 60, 110) are treated with high-energy radiation, especially UV radiation, gamma rays or electron beams.

24. The material according to claim 1, characterised in that at least a part of the cleaning elements (26, 28, 34, 58, 60, 110) is impregnated or coated with a material (112; 124) that increases their stiffness.

25. The material according to claim 24, characterised in that at least a part of the cleaning elements (26, 28, 34, 58, 60, 110) impregnated or coated with material (112; 124) that increases their stiffness has a portion (134) that is not impregnated or coated or that is impregnated or coated with a second material that increases the stiffness to a lesser extent.

26. The material according to claim 1, characterised in that at least some of the cleaning elements (26, 28, 34, 58, 60, 110) are impregnated or coated with an antimycotic and/or antibacterial active ingredient.

27. The material according to claim 1, characterised in that the base member (24) is a woven fabric, a knitted fabric, a braid, a nonwoven fabric, a felt, a sheaf of threads, a film or a similar structure to which the ends of the cleaning elements (26, 28, 34, 58, 60, 110) are fastened and which is stiffened at least in portions by a resilient impregnation material or a resilient coating.

28. The material according to claim 27, characterised in that at least some of the cleaning elements (26, 28, 34, 58, 60, 110) are portions of thread drawn out of the base member (24) which is composed of threads.

29. The material according to claim 1, characterised in that the base member (24) additionally carries bristles (58, 60) or has bristles passed through it, the length of which bristles is less than that of the cleaning elements (26, 28, 34, 58, 60, 110).

30. The material according to claim 1, characterized in that the diameter of the monofilament cleaning elements (110) is from 1 μm to 100 μm.

31. The material according to claim 30, characterized in that the diameter of the monofilament cleaning elements (110) is from 1 μm to 50 μm.

32. An implement for cleaning surfaces of teeth and denture materials, characterised in that it comprises a piece of material (22) made from a material according to claim 1, which piece of material preferably has a convex transverse cross-sectional geometry as a result of resilient prestressing or plastic deformation and is joined to a holding part (14; 42; 74; 80; 92).

33. The implement according to claim 32, characterised in that the base member (24) is arranged on a resilient head body (14) or is a portion thereof.

34. The implement according to claim 32 or 33, characterised in that the piece of material (22) is brought into the contoured form before, during or after curing of an impregnation material (90) or coating material (40) that infiltrates the base member (24).

35. The implement according to claim 32, characterized in that the length of the piece of material (22) is approximately from 15 to 30 mm, and the width of the piece of material (22) is approximately from 5 to 15 mm.

36. The implement according to claim 32, characterised in that two opposite ends of the piece of material (22) are provided with fastening means (76, 78) to which a holding shackle (80) is attached preferably under bias.

37. The implement according to claim 32, characterised in that the holding part (14; 42; 74; 80; 92) is moved by the power take-off part (84) of a vibrator (86), an ultrasound generator or an electric toothbrush drive.

38. The implement according to claim 32, characterised in that at least part of the edge of the piece of material (22) has an arrangement of helical or garland-shaped cleaning elements (34).

39. The implement according to claim 32, characterised in that the length of at least some of the cleaning elements (26, 28) increases towards at least one pair of opposite edges of the piece of material (22).

40. The implement according to claim 32, characterised in that at least some of the cleaning elements (60) at the edge of the piece of material (22) are inclined to the face of the base member (24).

41. The implement according to claim 32, characterised in that the base member (24) is permeable to liquid and the side thereof remote from the cleaning elements (26, 28, 34, 58, 60, 110) is connected to a supply channel (94) for treatment liquid which leads to a reservoir (98) for treatment fluid housed in a handle.

42. The implement according to claim 32, characterised in that the base member (24) is constructed as a finger cap.

43. A material for cleaning surfaces of teeth and denture materials, comprising a base member (24) and a plurality of cleaning elements (26, 28, 34, 58, 60, 110) carried by the base member (24), which cleaning elements have small transverse dimensions compared with their length, characterized in that the base member (24) is a flexible bendable structure and the cleaning elements (26, 28, 34, 58, 60, 110) are carried by the base member (24) in the manner of pile loops or pile threads, in that at least some of the cleaning elements are monofilaments (110) and in that the diameter of the monofilament cleaning elements (110) is from 1 μm to 500 μm.

44. The material according to claim 43, characterized in that the diameter of the monofilament cleaning elements (110) is from 1 μm to 100 μm.

45. The material according to claim 44, characterized in that the diameter of the monofilament cleaning elements (110) is from 1 μm to 50 μm.

46. A material for cleaning surfaces of teeth and denture materials, comprising a base member (24) and a plurality of cleaning elements (26, 28, 34, 58, 60) carried by the base member (24), which cleaning elements have small transverse dimensions compared with their length, characterized in that the base member (24) is a flexible bendable structure and the cleaning elements (26, 28, 34, 58, 60) are carried by the base member (24) in the manner of pile loops or pile threads, in that at least some of the cleaning elements are multifilaments and in that the diameter of the multifilament cleaning elements is from 1 μm to 500 μm.

47. The material according to claim 46, characterized in that the diameter of the multifilament cleaning elements is from 1 μm to 100 μm.

48. The material according to claim 47, characterized in that the diameter of the multifilament cleaning elements is from 1 μm to 50 μm.

49. A material for cleaning surfaces of teeth and denture materials, comprising a base member (24) and a plurality of cleaning elements (26, 28, 34, 58, 60, 100) carried by the base member (24), which cleaning elements have small transverse dimensions compared with their length, characterized in that the base member (24) is a flexible, bendable structure and the cleaning elements (26, 28, 34, 58, 60, 100) are carried by the base member (24) in the manner of a pile loops or pile threads, and at least some of the cleaning elements comprise multifilament fibers having a diameter of from about 10 μm, to 1000 μm.

50. The material according to claim 49, characterized in that the diameter of the multifilament cleaning elements (26, 28) is from 10 μm, to 50 μm.

51. The material according to claim 49, characterized in that the diameter of the multifilament cleaning elements (26, 28) is from 50 μm to 300 μm.

52. The material according to claim 49, characterized in that the cleaning elements are treated with high-energy radiation selected from UV radiation, gamma-rays or electron beams.

* * * * *